United States Patent [19]

Cooper, Jr.

[11] 4,210,991

[45] Jul. 8, 1980

[54] HYDRAULIC EXPANSION SWAGING OF TUBES IN TUBESHEET

[75] Inventor: Frank W. Cooper, Jr., Monroeville, Pa.

[73] Assignee: Westinghouse Electric Corp., Pittsburgh, Pa.

[21] Appl. No.: 939,553

[22] Filed: Sep. 5, 1978

[51] Int. Cl.[2] ..... B23P 11/00; B21D 26/02; B21D 39/08

[52] U.S. Cl. ..... 29/421 R; 72/56; 72/58

[58] Field of Search ..... 29/421 R, 421 E; 72/56, 72/58, 61, 62, DIG. 24, DIG. 25

[56] References Cited

U.S. PATENT DOCUMENTS

| | | | |
|---|---|---|---|
| 3,535,901 | 10/1970 | Tominaga | 29/421 R |
| 3,977,068 | 8/1976 | Krips | 29/421 R |
| 3,979,810 | 9/1976 | Krips et al. | 29/421 R |
| 4,061,139 | 12/1977 | Kauffman | 29/421 E |
| 4,069,573 | 1/1978 | Rogers et al. | 29/421 R |
| 4,125,937 | 11/1978 | Brown et al. | 29/421 R |

*Primary Examiner*—Ervin M. Combs
*Attorney, Agent, or Firm*—E. C. Arenz

[57] ABSTRACT

The method of this invention involves abruptly applying a very high pressure pulse to the already pressurized annular space between a hydraulic expansion-swaging mandrel core and the tube being swaged to obtain a practically zero gap, after removal of the pressure, between the tube and the bore in which it is being swaged.

7 Claims, 1 Drawing Figure

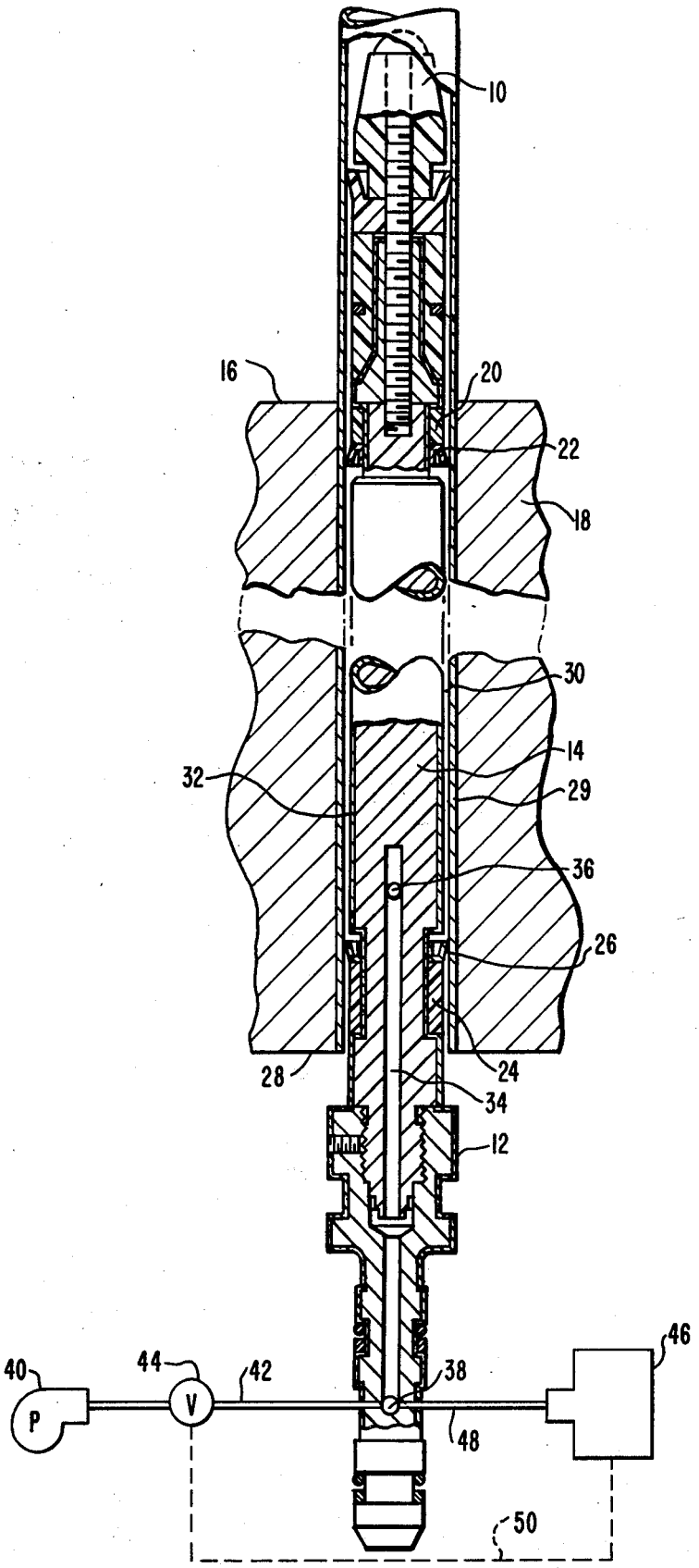
10
16
20
22
18
30
14
32
29
36
26
28
24
34
12
46
40
44
42
38
P
V
48
50

HYDRAULIC EXPANSION SWAGING OF TUBES IN TUBESHEET

CROSS-REFERENCE TO RELATED APPLICATION

My U.S. patent application Ser. No. 896,532, filed Apr. 14, 1978, now U.S. Pat. No. 4,159,564 discloses preferred hydraulic expansion-swaging mandrels with which the method of the present invention may be carried out.

BACKGROUND OF THE INVENTION

1. Field of the Invention

This invention pertains to the art of methods for hydraulically expansion-swaging a tube in a tubesheet such as is found in nuclear steam generators.

2. Description of the Prior Art

I am unaware of prior art relevant to the method of this invention. U.S. Pat. Nos. 3,977,086 and 3,979,810 disclose apparatus and methods for accomplishing basic hydraulic expansion-swaging. However, it is not believed that following the teachings of these patents would yield as satisfactory results from the tube expansion process as is obtainable with the method according to my invention.

It is desirable in hydraulically expanding a tube in a tubesheet bore, such as that of a nuclear steam generator, that there be essentially zero gap between the outer wall of the tube and the inner wall of the bore of the tubesheet after the expansion is completed.

It has been found in tube expansion studies in which the expansion pressure is progressively increased to expand a tube of the type used in nuclear steam generators against a tubesheet bore that as the pressure is progressively increased the tube basically yields to the tubesheet by about 10,000 psi ($69\times10^6$Pa), but without any residual clamping force between the tube and the tubesheet. However, with the pressure then continuing to be progressively increased to a range of about 31,500 psi to 33,500 psi ($217\times10^6$ to $231\times10^6$Pa), essentially a zero gap is provided between the tube and tubesheet with a residual clamping effect being produced. This residual clamping effect is basically a result of the tube, which is of one material, continuing to yield while the tubesheet material remains plastic. Even though the growth of the tube internal diameter by the end of the initial yielding may be very large compared to the subsequent yielding, such as 15 mils growth at the 10,000 psi value with a subsequent further yielding of perhaps only 2 mils with the increase in pressure to the higher values, obtaining the essentially zero gap is considered highly desirable in nuclear steam generators to reduce the possibility of crevice corrosion in any gap.

A problem with progressively increasing the pressure to the high values to obtain the essentially zero gap is that there is a tendency for the seals of the expansion mandrel to be extruded. While one approach to minimize this is to use a first and a second mandrel with a greater and a smaller radial gap between the mandrel and the tube, and with the first mandrel being used with a lower pressure and the second mandrel being used with a higher pressure, this approach is not considered as desirable as the approach which is the subject of this invention.

SUMMARY OF THE INVENTION

In accordance with my method of accomplishing the hydraulic expansion-swaging of a tube in the bore of a tube-sheet, a hydraulic expansion mandrel is inserted into the tube situated in the bore, fluid is introduced into the annular pressure space around the mandrel, the fluid is increased in pressure to a value in one predetermined lower range of pressures, and then a short pulse is applied to the fluid to increase the pressure of the fluid in the pressure space for a very short period to a significantly higher value which is at least double the lower value, and then the pressure in the annular space is released and the mandrel is removed.

DRAWING DESCRIPTION

The drawing is a single view, mostly in section, of a fragmentary part of a tubesheet with a tube in a bore therein and with the mandrel in position, with the remainder of the drawing being a schematic representation of the basic parts associated with the mandrel for carrying out the invention.

DESCRIPTION OF THE PREFERRED EMBODIMENT

In the drawing, the mandrel shown is the same rigid mandrel disclosed in my noted copending patent application and it will thus only be described briefly herein in the respects considered necessary for explaining this particular invention. Reference should be had to the copending application for details of the mandrel construction shown, as well as information on a flexible mandrel disclosed in the same copending application. The method of my invention is applicable for use with either of the mandrels.

The mandrel includes a leading end portion 10, a trailing portion 12 and an intermediate core portion 14.

The sealing arrangement at the leading end of the core, and which in use is located adjacent the secondary side face 16 of the tubesheet 18, comprises a back-up ring 20 and a sealing ring 22. The sealing arrangement toward the trailing end of the mandrel comprises a back-up ring 24 and a sealing ring 26, these elements being located adjacent the primary side face 28 of the tubesheet in the use of the mandrel.

A tube 29 to be expanded is shown in the bore of the tubesheet, this tube having an unexpanded inner diameter which is only slightly larger than the outer diameter of the intermediate core 14 of the mandrel. Accordingly, a very narrow annular pressure space 30 is defined radially between the mandrel core and the tube, and is defined axially by the opposite end seals of the mandrel. While in the drawing the core portion at least of the mandrel is shown as being covered by an electrically insulating skin 32, this is provided for purposes of carrying out the invention disclosed in my noted patent application and is not necessary for carrying out the present invention.

The core 14 and the trailing end portion 12 of the mandrel include an axially extending bore 34 with a port 36 which places that bore in communication with the annular space 30. Another port 38 is provided in the trailing end portion and a pressurizing fluid such as demineralized water is fed to the annular space 30 through port 38, bore 34 and port 36.

The schematic portion of the drawing includes a pump 40 which, for example, may be a Haskel Engineering Company intensifier pump, a conduit 42 connecting the pump to the port 38 and having therein an electric shut-off valve 44, and a pulsing device 46 also connected to the port 38 through conduit 48.

The pulsing device 46 may take any of several forms in which a strong potential force is abruptly released to provide a high instantaneous pressure in the annular pressure space 30. The potential energy may be stored in a compressed spring for example which, upon release, impacts a movable piston to provide a shock wave in the fluid. Or the potential energy may be stored in a pendulum which upon release impacts a movable piston. The dash line 50 indicates a connection between the pulsing device 46 and the valve 44 which is closed when the impulse is produced by the device 46.

In carrying out the method of the invention with the described arrangement, the hydraulic expansion mandrel is inserted into the tube 28 from the primary side of the tubesheet 18. The pump 40 is energized to introduce fluid into the annular pressure space 30 and to increase the pressure of the fluid to a value in a lower pressure range, such as 10,000 to 15,000 psi ($69\times10^6$ to $103\times10^6$Pa). When this pressure is reached the valve 44 is closed and the pulsing device 46 is actuated to apply a short pulse having a peak pressure in the range of about 40,000 to 44,000 psi ($276\times10^6$ to $304\times10^6$Pa). As currently viewed, the preferred range of duration of the pulse is about 50 milliseconds to 150 milliseconds.

With this method, while by far the majority of the yielding of the tube and its deformation against the bore of the tubesheet occurs during the expansion produced by the lower pressure, additional yielding of the tube occurs as a result of the high pressure pulse which, because of its short duration, does not allow for yielding of the tubesheet. The short duration of the pulse also avoids the problem of extruding the seals 22 and 26 at the opposite ends of the annular pressure space.

I claim:

1. The method of hydraulically expansion-swaging a tube into a bore of a tube sheet comprising:

inserting a hydraulic expansion mandrel into the length of tube situated in the bore;

introducing fluid into the annular pressure space defined radially between the mandrel core and said tube, and defined axially by the opposite end seals of the mandrel;

increasing the pressure of the fluid to a value in one predetermined lower range and, then, without reducing that pressure;

applying a short pulse to increase the pressure of the fluid in the annular pressure space for a very short period to a higher value of at least double said lower value, and finally releasing said pressure in said annular space and removing said mandrel.

2. The method of claim 1 wherein:

said predetermined lower value is in the range of about 10,000 to 15,000 psi.

3. The method of claims 1 or 2 wherein:

said short pulse has a duration in excess of about 50 milliseconds.

4. The method according to claims 1 or 2 wherein:

said higher value is in the range of about 40,000 to 44,000 psi.

5. The method according to claim 3 wherein:

said short pulse has a duration of less than 1 second.

6. The method of claim 1 wherein:

said short pulse is applied sufficiently abruptly, at a sufficiently high value and for a sufficiently short period that a residual clamping pressure results between the tube and tubesheet bore wall and with deformation of said tube occurring without significant yielding of said tubesheet.

7. The method of radially expanding a portion of a U-tube against a circumferential wall of a tubesheet bore of a nuclear steam generator comprising:

inserting an expansion mandrel having opposite end seal portions to a location in the bore such that the seals are within the bore and adjacent the opposite ends of the bore;

pumping the fluid through said mandrel and into the annulus defined between the outer walls of the mandrel and the inner wall of said bore between the end seals;

increasing the pressure of said fluid to a predetermined lower value;

then, without reducing that pressure, further increasing the pressure abruptly to a value sufficiently high to deform the tube material against the tubesheet bore wall, and for a sufficiently short time to avoid any significant yielding of the tubesheet material forming the bore; and finally relieving the pressure and removing said mandrel.

* * * * *